US009359173B2

(12) United States Patent
Dube

(10) Patent No.: US 9,359,173 B2
(45) Date of Patent: Jun. 7, 2016

(54) ELEVATOR GOVERNOR HAVING TWO TRIPPING MECHANISMS ON SEPARATE SHEAVES

(75) Inventor: Randall S. Dube, Glastonbury, CT (US)

(73) Assignee: Otis Elevator Company, Farmington, CT (US)

( * ) Notice: Subject to any disclaimer, the term of this patent is extended or adjusted under 35 U.S.C. 154(b) by 502 days.

(21) Appl. No.: 13/983,649

(22) PCT Filed: Feb. 7, 2011

(86) PCT No.: PCT/US2011/023890
§ 371 (c)(1),
(2), (4) Date: Aug. 5, 2013

(87) PCT Pub. No.: WO2012/108859
PCT Pub. Date: Aug. 16, 2012

(65) Prior Publication Data
US 2013/0306409 A1 Nov. 21, 2013

(51) Int. Cl.
*B66B 5/06* (2006.01)
*B66B 5/04* (2006.01)

(52) U.S. Cl.
CPC ..... *B66B 5/044* (2013.01)

(58) Field of Classification Search
CPC ..... B66B 5/044
USPC ..... 187/254, 287, 288, 305, 373, 391, 393
See application file for complete search history.

(56) References Cited

U.S. PATENT DOCUMENTS 1,977,452 A 10/1934 Neuschotz
3,695,396 A 10/1972 Jones
(Continued)

FOREIGN PATENT DOCUMENTS

EP 2243739 A2 10/2010
JP 8002848 A 1/1996
(Continued)

OTHER PUBLICATIONS

Chinese Search Report for Application No. 2011800669091 dated Jan. 26, 2015.
(Continued)

*Primary Examiner* — Anthony Salata
(74) *Attorney, Agent, or Firm* — Carlson, Gaskey & Olds

(57) ABSTRACT

An exemplary elevator system includes an elevator car. A first governor sheave is supported on the elevator car for movement with the elevator car. The first governor sheave is supported for rotational movement relative to the elevator car responsive to movement of the elevator car. A first governor tripping mechanism is supported on the first governor sheave. The first governor tripping mechanism provides an indication to perform a first governor function for controlling the speed of the elevator car responsive to the elevator car moving at a speed above a first threshold speed. A second governor sheave is supported on the elevator car for movement with the elevator car and for rotational movement relative to the elevator car responsive to movement of the elevator car. A second governor tripping mechanism is supported on the second governor sheave. The second governor tripping mechanism provides an indication to perform a second governor function for controlling a speed of the elevator car responsive to the elevator car moving at a speed above a second threshold speed.

20 Claims, 2 Drawing Sheets

(56) References Cited

U.S. PATENT DOCUMENTS

| | | | | |
|---|---|---|---|---|
| 4,083,432 | A | 4/1978 | Lusti | |
| 4,977,982 | A | 12/1990 | Bialy et al. | |
| 5,052,523 | A | 10/1991 | Ericson | |
| 5,299,661 | A * | 4/1994 | Pramanik | B66B 5/044 187/373 |
| 5,310,022 | A | 5/1994 | Sheridan et al. | |
| 5,407,028 | A * | 4/1995 | Jamieson | B66B 5/10 187/287 |
| 5,487,450 | A | 1/1996 | Gerber | |
| 5,513,723 | A | 5/1996 | Luebke | |
| 5,797,472 | A | 8/1998 | Kamani et al. | |
| 6,170,614 | B1 * | 1/2001 | Herkel | B66B 1/32 187/287 |
| 6,360,847 | B1 * | 3/2002 | Okada | B66B 5/044 187/373 |
| 6,454,054 | B1 | 9/2002 | Tanino et al. | |
| 6,564,907 | B1 | 5/2003 | Sasaki | |
| 6,691,834 | B2 | 2/2004 | Sanchez et al. | |
| 6,752,246 | B2 | 6/2004 | Takai et al. | |
| 6,988,593 | B2 | 1/2006 | Sanchez et al. | |
| 7,014,014 | B2 * | 3/2006 | Mueller | B66B 5/06 187/288 |
| 7,475,756 | B2 | 1/2009 | Maury et al. | |
| 7,537,090 | B2 | 5/2009 | Vantanen | |
| 7,575,099 | B2 | 8/2009 | Oh et al. | |
| 7,607,516 | B2 | 10/2009 | Simon et al. | |
| 8,069,956 | B2 * | 12/2011 | Okada | B66B 5/044 187/287 |
| 8,342,294 | B2 | 1/2013 | Madoz Michaus et al. | |
| 2004/0134726 | A1 | 7/2004 | Sanchez et al. | |
| 2008/0245617 | A1 | 10/2008 | Madoz Michaus et al. | |
| 2009/0014256 | A1 * | 1/2009 | Matsuoka | B66B 5/0018 187/393 |
| 2012/0103732 | A1 * | 5/2012 | Kwon | B66B 5/044 187/305 |
| 2013/0220739 | A1 * | 8/2013 | Okada | B66B 5/04 187/254 |
| 2014/0367206 | A1 * | 12/2014 | Della Porta | B66B 5/06 187/305 |
| 2015/0083528 | A1 * | 3/2015 | Kattainen | B66B 5/0031 187/393 |
| 2015/0136544 | A1 * | 5/2015 | Dube | B66B 5/044 188/180 |

FOREIGN PATENT DOCUMENTS

| | | | |
|---|---|---|---|
| JP | 2009154984 | A | 7/2007 |
| WO | 03055780 | A1 | 7/2003 |
| WO | 2006070436 | | 7/2006 |
| WO | 2008079106 | A1 | 7/2008 |

OTHER PUBLICATIONS

International Preliminary Report on Patentability for International application No. PCT/US2011/023890 dated Aug. 22, 2013.

International Search Report and Written Opinion of the International Searching Authority for International application No. PCT/US2011/023890 dated Nov. 18, 2011.

* cited by examiner

ELEVATOR GOVERNOR HAVING TWO TRIPPING MECHANISMS ON SEPARATE SHEAVES

BACKGROUND

Elevator systems include a variety of devices for providing control over movement of the elevator car. Elevator governors for protecting against over speed conditions are well known. Most elevator governors include a tripping mechanism located near the top of the hoistway. A governor rope extends along the length of the hoistway wrapping around a governor sheave associated with the tripping mechanism and an idler sheave associated with a tension weight near an opposite end of the hoistway. The elevator car is connected with the rope so that the rope moves as the elevator car moves. If the elevator car moves at a speed that is higher than desired, the speed of rotation of the governor sheave activates the tripping mechanism.

Governors in elevators systems are used for two purposes. One use of an elevator governor is for activating or dropping the machine brake and interrupting power to the machine motor in the event of an over speed condition. The other use is for activating elevator safeties that engage the guide rails, for example, in the event of a further over speed condition. Given that the governor reaction to each over speed condition is not independent, it is difficult to achieve specific control over the speed at which the governor performs both functions. Additionally, relying upon a single governor tripping mechanism for both functions introduces additional challenges when satisfying some codes for low speed elevators.

SUMMARY

An exemplary elevator system includes an elevator car. A first governor sheave is supported on the elevator car for movement with the elevator car. The first governor sheave is supported for rotational movement relative to the elevator car responsive to movement of the elevator car. A first governor tripping mechanism is supported on the first governor sheave. The first governor tripping mechanism provides an indication to perform a first governor function for controlling the speed of the elevator car responsive to the elevator car moving at a speed above a first threshold speed. A second governor sheave is supported on the elevator car for movement with the elevator car and for rotational movement relative to the elevator car responsive to movement of the elevator car. A second governor tripping mechanism is supported on the second governor sheave. The second governor tripping mechanism provides an indication to perform a second, different governor function for controlling movement of the elevator car responsive to the elevator car moving at a speed above a second threshold speed.

An exemplary method for controlling movement of an elevator car includes providing an indication from a first governor tripping mechanism to perform a first governor function for controlling a speed of the elevator car responsive to the elevator car moving at a speed above a first threshold speed. The first governor tripping mechanism is supported on a first governor sheave that is supported on the elevator car. A second tripping mechanism is supported on a second governor sheave that is also supported on the elevator car. An indication from the second governor tripping mechanism is provided to perform a second, different governor function for controlling movement of the elevator car responsive to the elevator car moving at a speed above a second threshold speed.

The separate governor tripping mechanisms each supported on its own governor sheave provides specific control over the tripping mechanism reaction at a desired, corresponding threshold speed. The separate tripping mechanisms on their own governor sheaves also provides more flexibility and a more reliable arrangement compared to using a single tripping mechanism to perform both functions.

The various features and advantages of this invention will become apparent to those skilled in the art from the following detailed description. The drawings that accompany the detailed description can be briefly described as follows.

DETAILED DESCRIPTION

Figure 1:
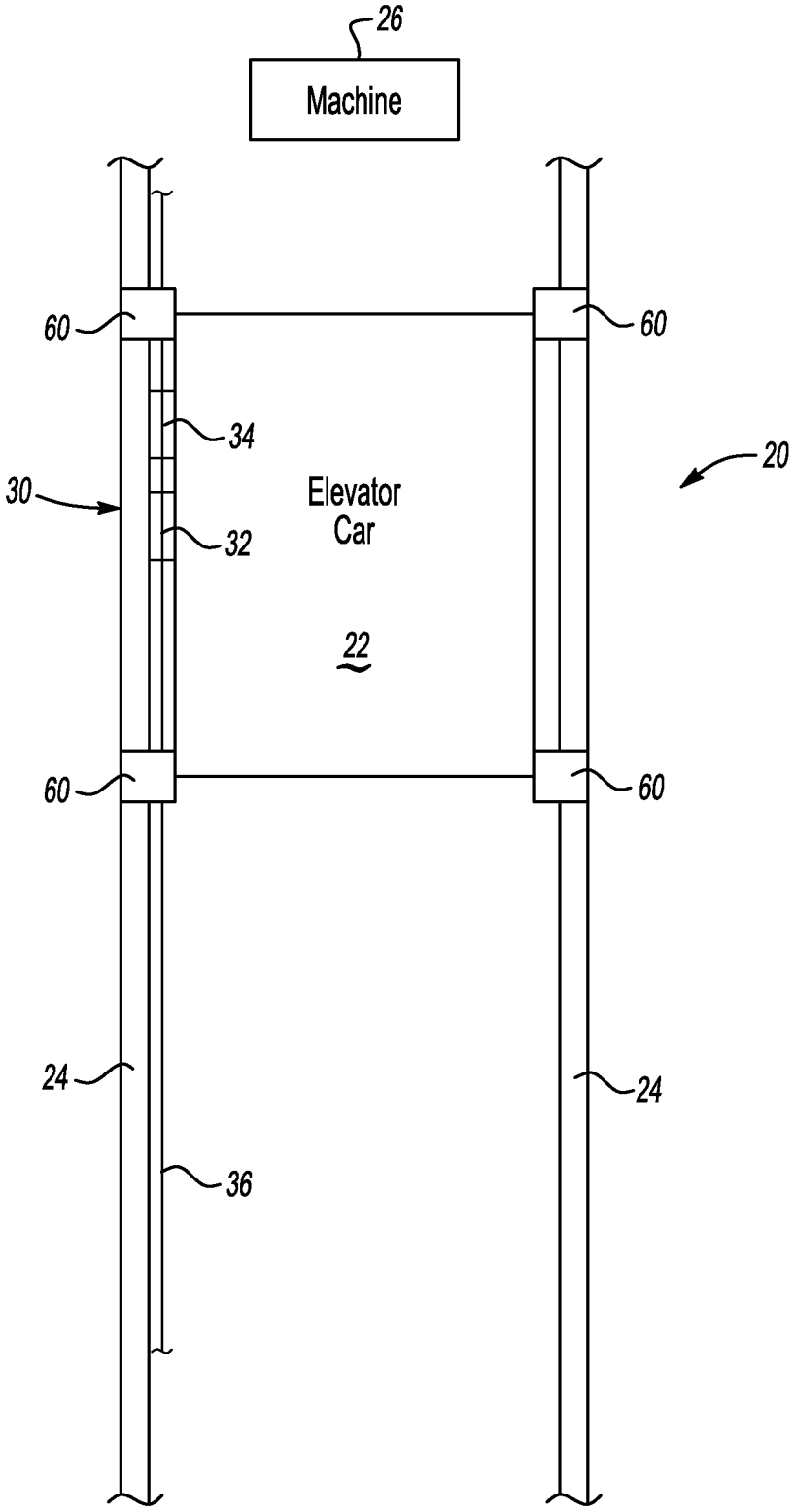
FIG. 1 schematically illustrates selected portions of an example elevator system designed according to an embodiment of this invention.

FIG. 1 schematically shows selected portions of an elevator system 20. An elevator car 22 is supported in a known manner for movement along guide rails 24. An elevator machine 26 includes a motor and brake for controlling movement of the elevator car 22 in a generally known manner.

A governor assembly 30 is provided for protecting against over speed conditions in which the elevator car 22 moves at a speed that is higher than a desired speed. The governor assembly 30 includes a first governor sheave 32 supported on the elevator car 22 for movement with the elevator car 22 as it moves along the guide rails 24. The first governor sheave 32 rotates relative to the elevator car 22 as the car 22 moves along the guide rails 24. A second governor sheave 34 is also supported on the elevator car 22 and is rotatable relative to the elevator car 22. A governor rope 36 has ends that remain near ends of the hoistway, for example, in which the elevator car 22 is situated. In one example, an upper end is fixed and a lower end is attached to a hanging mass to maintain a desired tension on the governor rope 36. The hanging mass is situated to allow for limited, guided vertical movement in some examples. The governor rope 36 at least partially wraps around each of the governor sheaves 32 and 34 so that each sheave rotates as the elevator car 22 moves relative to the governor rope 36.

Figure 2:
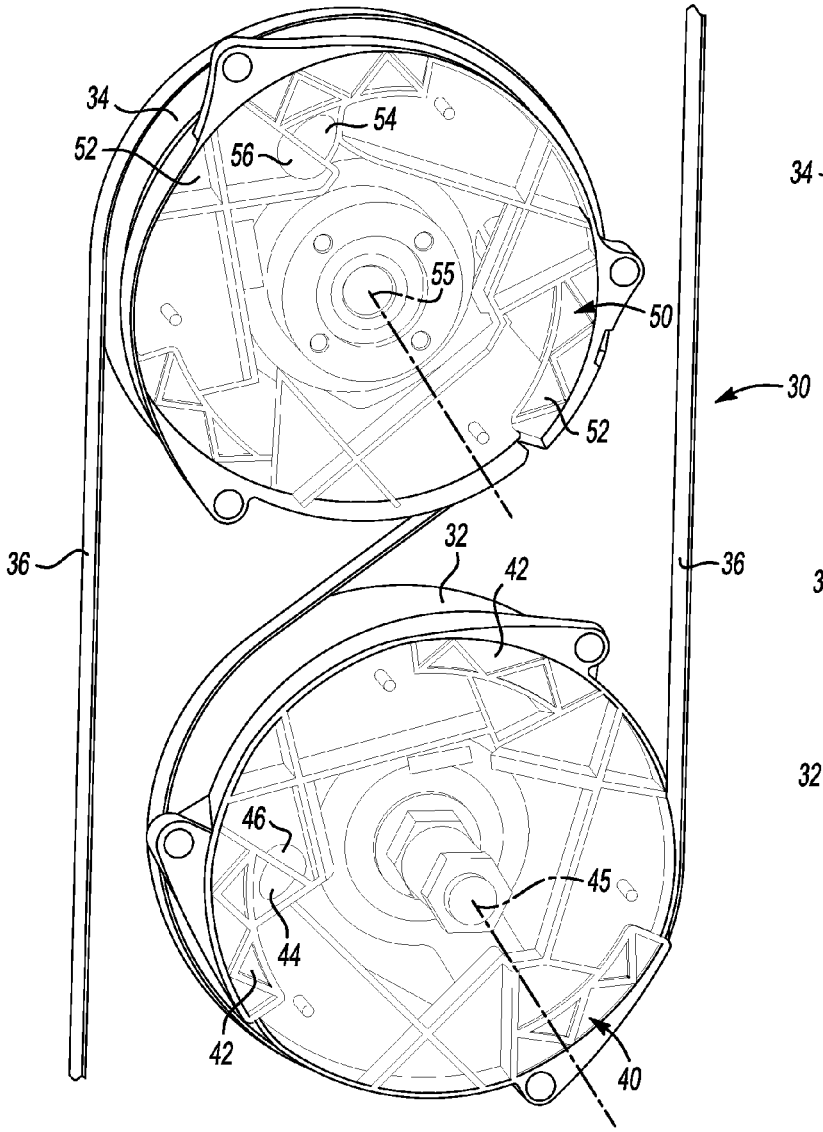
FIG. 2 diagrammatically illustrates one example governor arrangement designed according to an embodiment of this invention.

FIG. 2 diagrammatically illustrates an example arrangement of the governor assembly 30. A first governor tripping mechanism 40 is supported on the first governor sheave 32. A plurality of centrifugal elements 42 rotate with the first governor sheave 32 as the elevator car 22 moves. The centrifugal elements 42 are maintained in an inactivated position by biasing members 44. When the speed of rotation of the first governor sheave 32 exceeds a selected first threshold, the centrifugal force exerted on elements 42 overcomes the force of the biasing members 44 and the elements 42 move at least partially in a radially outward direction relative to an axis of rotation 45 of the first governor sheave 32. When the centrifugal elements 42 move outwardly, they interact with an actuator mechanism (not illustrated) that works in a known manner to perform a first governor function. In one example, the first governor function is to cause activation (e.g., dropping) of the machine brake 26 for slowing down movement of the elevator car 22 and interrupting power to the machine motor. In another example the first governor function is to control a speed of movement of the elevator car 22 in either an upward or a downward direction.

In this example, the biasing member 44 comprises a magnet that cooperates with a magnetic portion 46 for maintaining the centrifugal elements 42 in a first inactivated position (illustrated in FIG. 2, for example) relative to the first governor sheave 32 whenever the first governor sheave 32 rotates at a speed below the first threshold speed. When the speed of the elevator car 22 exceeds the first threshold, the corresponding speed of rotation of the first governor sheave 32 and centrifugal force on the elements 42 overcomes the magnetic force of attraction between the magnet 44 and the magnetic portion 46, such that the centrifugal elements 42 move outward to provide an indication to perform the first governor function.

Although the illustrated examples include magnetic biasing members, other embodiments include different biasing members such as springs.

The second governor sheave 34 supports a second governor tripping mechanism 50 that includes centrifugal elements 52. A biasing member 54, which is a magnet in this example, biases the centrifugal elements 52 into a retracted position (shown in FIG. 2) as the governor sheave 34 rotates about an axis of rotation 55. When the speed of the elevator car 22 exceeds a selected second threshold, the corresponding speed of rotation of the second governor sheave 34 and centrifugal force on the elements 52 overcomes the biasing force of the biasing member 54, and the centrifugal elements 52 move in a radially outward direction relative to the axis 55. Under such conditions, the second governor tripping mechanism 50 provides an indication to perform a second governor function. In one example the second governor function is to activate supplemental brakes such as elevator safeties 60 (generally shown in FIG. 1) provided on the elevator car 22. The elevator safeties 60 in this example engage the guiderail 24 to cause the elevator car 22 to stop in a known manner. Another example second governor function is to control elevator car movement in a direction opposite to that associated with the first governor function.

In an illustrative example, the biasing member 54 comprises a magnet that cooperates with a magnetic portion 56 for maintaining the centrifugal elements 52 in a first position relative to the second governor sheave 34 at speeds below the second threshold speed.

The illustrated governor assembly 30 includes separate governor sheaves 32 and 34 and separate governor tripping mechanisms 40 and 50 to provide separate, independent control over the two distinct governor functions. This independent control over each function increases the accuracy with which each function is performed. The independent mechanisms also provide greater flexibility for addressing a variety of situations.

For example, it is possible to independently control the first threshold speed at which the machine brake is dropped (and power to the machine motor is interrupted) and the second, higher threshold speed at which supplemental brakes such as the elevator safeties 60 are engaged. The first threshold speed and second threshold speed can be selected to meet the needs of a particular situation. The separate governor sheaves 32 and 34 and the corresponding separate tripping mechanisms provide precise control over the activation provided by each tripping mechanism to separately address the different over speed conditions associated with the two different threshold speeds. Such an arrangement is superior to a governor assembly that relies upon a single tripping mechanism to provide activation of the machine brake and a supplemental brake, for example, at different threshold speeds.

In one example, each tripping mechanism is dedicated to controlling elevator speed in a specific direction. The first governor sheave 32 and its first tripping mechanism 40 are used for controlling upward movement of the elevator car 22. The second tripping mechanism 50 in such an example is used for controlling a speed of downward movement of the elevator car 22. Having two independently activated tripping mechanisms provides the ability to select different threshold speeds for the respective directions.

The example of FIG. 2 includes the governor rope 36 at least partially wrapping around each of the governor sheaves 32 and 34. In this example, the angle of wrap around each governor sheave is at least 240° to provide reliable engagement between the governor rope 36 and each of the governor sheaves 32 and 34, respectively. In this example, the first governor sheave 32 rotates in one direction and the second governor sheave 34 rotates in an opposite direction.

The tripping mechanisms 40 and 50 can comprise the same components. The force exerted by the second biasing member 54 in some examples is greater than the force exerted by the first biasing member 44, so that the second tripping mechanism 50 provides an indication for activating the supplemental brake at a higher speed compared to that at which the first tripping mechanism 40 provides an indication to activate the machine brake 26 (and interrupt power to the motor). In one example, a stronger magnet is used for the biasing member 54 of the second tripping mechanism 50 compared to that biasing member 44 used for the first tripping mechanism 40. In another example, the centrifugal elements 52 of the second tripping mechanism 50 are configured differently than the centrifugal elements 42 of the first tripping mechanism 40. For example, different weights may be used to alter the speeds at which the tripping mechanisms provide their respective indications. Different weight allows for all centrifugal elements and magnets to be the same and have different tripping speeds. Those skilled in the art who have the benefit of this description will realize how to configure two tripping mechanisms to realize two separate threshold speeds at which each provides an indication for performing a corresponding governor function.

Figure 3:
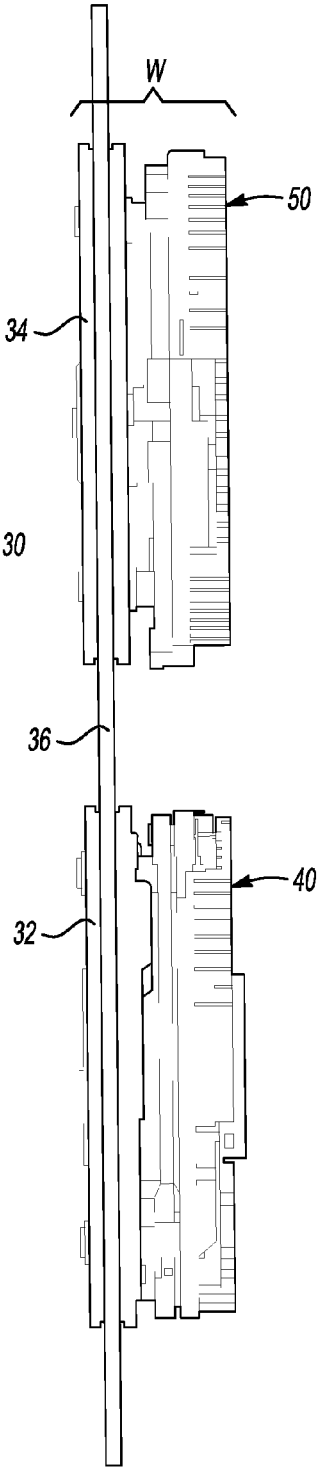
FIG. 3 is a side view of the arrangement shown in FIG. 2.

One feature of the illustrated example is that the governor sheaves 32 and 34 rotate about separate axes 45 and 55, respectively. That arrangement combined with the profile of the tripping mechanisms 40 and 50 allows for realizing a relatively narrow governor assembly 30 having a width w shown in FIG. 3. Given that the governor assembly 30 is mounted onto an elevator car 22, it is desirable to fit that within the small space constraints of a typical hoistway. The illustrated example allows for positioning the governor assembly 30 on the elevator car 22 so that it readily fits between a side of the elevator car 22 and a hoistway wall adjacent that side.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. An elevator system, comprising:

an elevator car;

a first governor sheave supported on the elevator car for movement with the elevator car and for rotational movement relative to the elevator car responsive to movement of the elevator car;

a first governor tripping mechanism supported on the first governor sheave that provides an indication to perform a first governor function to control movement of the elevator car responsive to the elevator car moving at a speed above a first threshold speed;

a second governor sheave supported on the elevator car for movement with the elevator and for rotational movement relative to the elevator car responsive to movement of the elevator car;

a second governor tripping mechanism supported on the second governor sheave that provides an indication to perform a second governor function to control movement of the elevator car responsive to the elevator car moving at a speed above a second threshold speed.

2. The elevator system of claim 1, wherein the first and second governor tripping mechanisms comprise centrifugal elements that are biased into a first position relative to the corresponding governor sheave, the centrifugal elements moving outward toward a second position responsive to movement of the elevator car near the corresponding threshold speed.

3. The elevator system of claim 2, wherein the centrifugal elements of the first governor tripping mechanism are configured to move out of the first position at a first sheave rotation speed and the centrifugal elements of the second governor tripping mechanism are configured to move out of the first position at a second, higher sheave rotation speed.

4. The elevator system of claim 3, comprising weights secured to the centrifugal elements and wherein the weights of the first governor tripping mechanism are different than the weights of the second governor tripping mechanism.

5. The elevator system of claim 3, wherein a biasing member that biases the centrifugal elements of the first governor tripping mechanism exerts a lower biasing force than a biasing member of the second governor tripping mechanism.

6. The elevator system of claim 5, wherein the biasing member of each governor tripping mechanism comprises a magnet and a magnetic force of the magnet of the first governor tripping mechanism is lower than a magnetic force of the magnet of the second governor tripping mechanism.

7. The elevator system of claim 1, comprising a governor rope that remains essentially fixed relative to the elevator car, each of the governor sheaves engaging the governor rope and rotating relative to the governor rope as the elevator car moves.

8. The elevator system of claim 7, wherein the governor rope wraps at least partially around each of the governor sheaves, the first governor sheave rotates in a first direction and the second governor sheave rotates in a second, opposite direction.

9. The elevator system of claim 1, wherein the first governor function comprises activating a machine brake for reducing a speed of the elevator car and the second governor function comprises activating a supplemental brake for stopping the elevator car.

10. The elevator system of claim 1, wherein the first governor function comprises controlling a speed of elevator car movement in a first direction and the second governor function comprises controlling a speed of elevator car movement in a second, opposite direction.

11. A method for controlling movement of an elevator car having first and second governors supported on the elevator car for movement with the elevator car and for rotational movement relative to the elevator car responsive to movement of the elevator car and first and second governor tripping mechanisms each supported on one of the governor sheaves, comprising the steps of:

providing an indication from the first governor tripping mechanism to perform a first governor function for controlling a speed of the elevator car responsive to the elevator car moving at a speed above a first threshold speed; and providing an indication from the second governor tripping mechanism to perform a second governor function for controlling speed of the elevator car responsive to the elevator car moving at a speed above a second threshold speed.

12. The method of claim 11, wherein the first and second governor tripping mechanisms comprise centrifugal elements that are biased into a first position relative to the corresponding governor sheave, the centrifugal elements moving outward toward a second position responsive to movement of the elevator car near the corresponding threshold speed.

13. The method of claim 12, wherein the centrifugal elements of the first governor tripping mechanism are configured to move out of the first position at a first sheave rotation speed and the centrifugal elements of the second governor tripping mechanism are configured to move out of the first position at a second, higher sheave rotation speed.

14. The method of claim 13, wherein each centrifugal element includes at least one weight and the weights of the first governor tripping mechanism are different than the weights of the second governor tripping mechanism.

15. The method of claim 13, wherein a biasing member that biases the centrifugal elements of the first governor tripping mechanism exerts a lower biasing force than a biasing member of the second governor tripping mechanism.

16. The method of claim 15, wherein the biasing member of each governor tripping mechanism comprises a magnet and a magnetic force of the magnet of the first governor tripping mechanism is lower than a magnetic force of the magnet of the second governor tripping mechanism.

17. The method of claim 11, comprising providing a governor rope having remains essentially fixed relative to the elevator car; and engaging the governor rope with the governor sheaves such that the governor sheaves rotate relative to the governor rope as the elevator car moves.

18. The method of claim 17, comprising rotating the first governor sheave in a first direction and rotating the second governor sheave in a second, opposite direction.

19. The method of claim 11, wherein the first governor function comprises activating a machine brake for reducing a speed of the elevator car and the second governor function comprises activating a supplemental brake for stopping the elevator car.

20. The method of claim 11, wherein the first governor function comprises controlling a speed of elevator car movement in a first direction and the second governor function comprises controlling a speed of elevator car movement in a second, opposite direction.

* * * * *